United States Patent [19]

McIntyre

[11] Patent Number: 4,883,691

[45] Date of Patent: Nov. 28, 1989

[54] METHOD OF AND APPARATUS FOR MAINTAINING UNIFORM HOT MELT COATINGS ON THERMALLY SENSITIVE WEBS BY MAINTAINING DIMENSIONAL STABILITY OF SILICONE AND RUBBER-LIKE WEB BACK-UP ROLLS

[75] Inventor: Frederic S. McIntyre, Wellesley, Mass.

[73] Assignee: Acumeter Laboratories, Inc., Marlborough, Mass.

[21] Appl. No.: 270,215

[22] Filed: Nov. 14, 1988

Related U.S. Application Data

[62] Division of Ser. No. 53,386, May 22, 1987, Pat. No. 4,805,554.

[51] Int. Cl.[4] ..... B05D 1/26

[52] U.S. Cl. ..... 427/434.2; 427/208.2; 427/256; 118/60; 118/410; 118/681; 118/666

[58] Field of Search ..... 427/208.2, 434.2, 256; 165/89; 118/59, 60, 410, 411, 666, 674, 680, 681

[56] References Cited

U.S. PATENT DOCUMENTS

| | | | |
|---|---|---|---|
| 2,089,524 | 8/1937 | Abrams et al. | 118/60 X |
| 3,185,816 | 5/1965 | Lusebrink | 165/89 X |
| 3,595,204 | 7/1971 | McIntyre et al. | 118/8 |
| 3,706,298 | 12/1972 | Norman | 118/666 |
| 3,802,495 | 4/1974 | Hordis | 432/60 X |
| 4,020,194 | 4/1977 | McIntyre et al. | 427/172 |
| 4,048,950 | 9/1977 | Rakowicz et al. | 118/411 X |
| 4,085,794 | 4/1978 | Mueller | 165/89 X |
| 4,090,469 | 5/1978 | Roberts, Jr. | 118/410 |
| 4,121,535 | 10/1978 | Roberts, Jr. et al. | 118/410 X |
| 4,218,499 | 8/1980 | Shinohara et al. | 118/60 X |
| 4,371,571 | 2/1983 | McIntyre | 118/410 X |
| 4,386,998 | 6/1983 | McIntyre et al. | 118/411 X |
| 4,476,165 | 10/1984 | McIntyre | 427/258 |
| 4,569,864 | 2/1986 | McIntyre | 118/674 X |

FOREIGN PATENT DOCUMENTS

| | | | |
|---|---|---|---|
| 1419647 | 12/1975 | United Kingdom | 118/410 |

*Primary Examiner*—Shrive Beck
*Assistant Examiner*—Alain Bashore
*Attorney, Agent, or Firm*—Rines and Rines, Shapiro and Shapiro

[57] ABSTRACT

Uniformity of hot melt coatings on thermally sensitive plastic and other webs is maintained by use of a silicone or other rubber-like web back-up roll the dimensional stability of which is maintained during hot melt coating of the webs by a heat-conducting idler roll directly contacting the back-up roll temperature and a heat transfer source for temperature deficiencies on the silicone roll surface, aiding constant nozzle-to-web spacing irrespective of temperature variations and line speeds. Provision is also made for the introduction of chilling, if required.

6 Claims, 4 Drawing Sheets

METHOD OF AND APPARATUS FOR MAINTAINING UNIFORM HOT MELT COATINGS ON THERMALLY SENSITIVE WEBS BY MAINTAINING DIMENSIONAL STABILITY OF SILICONE AND RUBBER-LIKE WEB BACK-UP ROLLS

CROSS-REFERENCE TO RELATED APPLICATION

This is a divisional patent application of U.S. Ser. No. 053,386, filed May 22, 1987 now U.S. Pat. 4,805,554.

BACKGROUND OF THE INVENTION

The present invention relates to hot melt adhesive and similar coating systems and techniques, being more particularly directed to such systems using thermally sensitive web surfaces in which temperature variations, including those caused by the hot melt depositions, introduce coating variation and degradation.

Previous patents of the common assignee of the present invention, including U.S. Pat. Nos. 3,595,204; 4,020,194; and 4,476,165, describe suitable slot nozzles and applicators for dispensing hot melt adhesive and similar fluid coatings upon moving webs in continuous or intermittent patterns for a myriad of applications ranging from tapes and labels to disposable diaper products and sanitary napkins and the like. There are occasions, however, particularly where very thermally sensitive web materials are involved, as of polyethelene (melting temperature of the order of 140° F.), polypropylene and polyvinyl chloride films or webs and the like, that the hot melt fluid and dispensing nozzle temperatures (order of 300° F. for ethelene vinyl acetate—EVA—or rubber-based hot melts as described in said patents) cause temperature shocks and variations that result in deleterious coating variations and product degradation. It is, accordingly, to the solution of such problems attendant upon the use of hot melt coatings with such thermally sensitive films and the like that the present invention is principally directed.

SUMMARY OF THE INVENTION

An object of the invention, accordingly, is to provide a new and improved method of and apparatus for maintaining uniform hot melt coatings and the like on thermally sensitive webs or films by processing techniques and equipment that maintain the dimensional stability of silicone or other rubber-like web back-up rolls to insure against the undesirable effects of temperature shocks and variations during hot melt coating and start and stop coating operation.

A further object is to provide a novel coating and temperature control web-handling system of more general utility, as well.

Other and further objects will be explained hereinafter and are more particularly delineated in the appended claims.

In summary, however, from one of its important viewpoints, the invention embraces a method of maintaining uniform hot melt coatings on thermally sensitive webs by maintaining the dimensional stability of silicone and rubberlike web back-up rolls that would otherwise be subject to dimensional variations as hot melt is deposited from a nozzle upon the front of the web, with attendant nozzle-to-web spacing variation as well, the method comprising, continuously contacting the surface of the back-up roll with a heat-conducting roll that, with increased surface temperature of the back-up roll, can remove heat as a heat sink from the back-up roll or supply chilling, and, with decrease in back-up roll surface temperature can directly heat the surface of the back-up roll; sensing variations in temperature of the surface of the back-up roll in response to the deposition of hot melt from the nozzle onto the front of the web and the transfer of heat from the back-up roll to the back of the web that would tend to introduce web coating variations and degradation; and controlling the temperature of the heat-conducting roll in response to such sensing to control the direct transfer of heat between the back-up and heat-conducting rolls and vice versa so as to maintain the substantial dimensional stability of the back-up roll and of the nozzle-to-web spacing. Preferred and best mode embodiments and details are later presented.

BRIEF DESCRIPTION OF THE DRAWINGS

The invention will now be described with reference to the accompanying drawings, FIGS. 1A and 1B of which are similar diagram views of apparatus constructed in accordance with a preferred mode of the invention particularly designed for the practice of the underlying novel method thereof and illustrating web stop and travel-coating conditions, respectively.

DESCRIPTION OF THE PREFERRED EMBODIMENTS

Figure 1B:
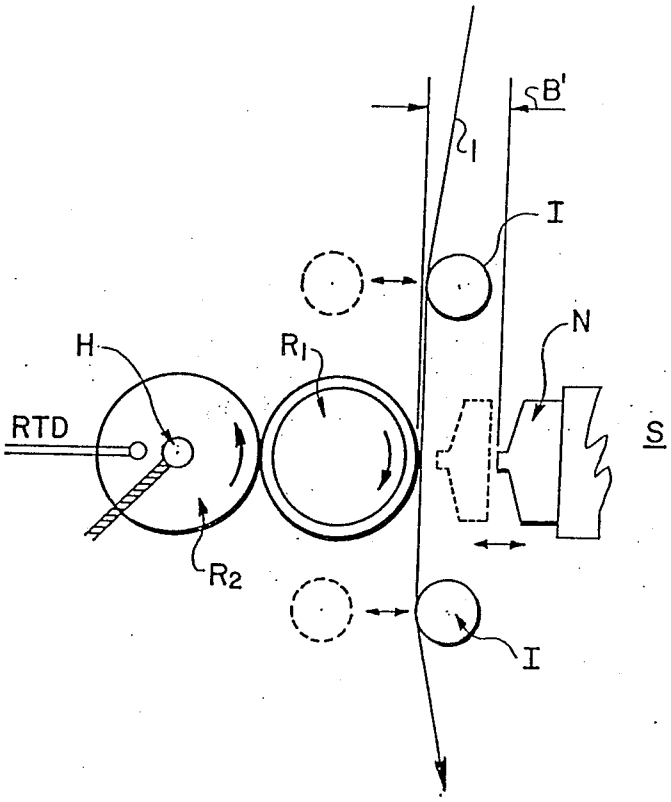
Figure 1A:
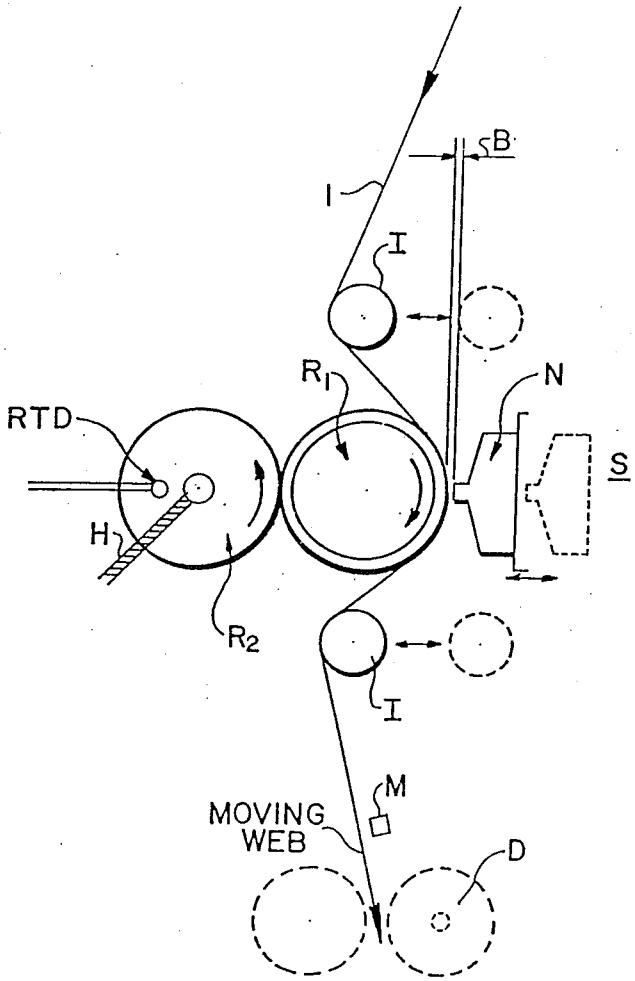

Referring to the drawings, a web 1 as of such thermally sensitive plastic sheeting or film and the like is shown in FIG. 1A moved by conventional drive rolls D over idlers I and through a coating station comprising a nozzle N, as, for example, of the slot type described in said patents, and which deposits hot melt fluid from a metered supply S, also described in said patents, continuously or intermittently, as desired, upon the web. In accordance with the invention, a silicone or other rubber-like back-up roll $R_1$ tangentially engages the back of the web 1 (to the left in the drawing) at a region opposite the region where the nozzle N deposits the hot melt coating on the front (or right-hand) side of the web 1—the nozzle being a predetermined spacing distance B from the web for the particular application. As before intimated, it is important for uniform coating results and for resisting degradation of the web and coating, that the spacing B be maintained constant, even though the insulating and non-heat transfering surface of the back-up roll $R_1$ is subjected to the heat of hot melt transferred through contact with the web, with the time of heat transfer being a lagging phenomenon, tending to produce resulting dimensional variations in $R_1$ that effectively vary the spacing B (the heat transfer to the web generally being greater than the specific heat of the silicone of the back-up roll $R_1$).

Figure 3A:
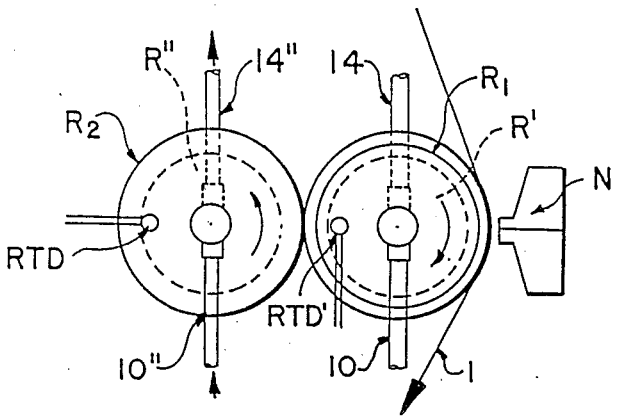
FIGS. 3A–B and FIGS. 4A and 4B respectively illustrate alternative heating and chilling techniques for the back-up roll assembly of FIGS. 1A and B.

While some degree of compensation might be effected by correspondingly moving the nozzle N to maintain uniformity of the coating thickness, the present invention more practically achieves this end and with timely temperature responsiveness by contacting the silicone or similar back-up roll $R_1$ with a heat-conducting roll $R_2$, preferably idling and with similar dimensions to the back-up roll $R_1$, as shown, as of metal. The heat-conducting roll $R_2$ thus directly contacts the surface of the back-up roll $R_1$ and acts, with increased surface temperature of the back-up roll, to remove heat as a heat sink from the same; and, with decrease in back-up roll surface temperature, is provided with a heat supply H, such as electrical heaters as in FIGS. 3A and 3B, directly to transfer heat to the surface of the back-up roll $R_1$—being operated generally around the before-mentioned 300° F., for example, to match the same temperature of the applied hot melt. The temperature of the back-up roll $R_1$, as affected by the hot melt application to the web, is monitored by, for example, a resistance type sensor (RTD) to control the heat supplied by the heat supply H and thus the heat directly contact-transferred by the roll $R_2$ to the back-up roll surface $R_1$ (and vice versa) in response to such sensing, thereby to maintain the substantial dimensional stability of the back-up roll $R_1$ and thus the constancy of the nozzle-to-web spacing B and coating uniformity. The roll $R_2$ will act as a heat sink for excessive heat developing on the silicone back-up roll $R_1$ and will serve, also, to replenish a deficiency of temperature on the silicone roll surface, insuring a substantially dimensionally stable diameter back-up roll throughout the operation. The nozzle-to-web gap B thus remains substantially uniform during the coating process irrespective of heating effects and line speed variations. (The terms "heat", "heating" and "heat-conducting" herein are often used in their generic sense to refer to the effect of relative differences in temperature and the conduction of temperature effects, including cold as well as hot temperatures.)

To prevent the back-up roll $R_1$ from cooling during stoppage or the rest condition of web and the coating process, shown in FIG. 1B, it is kept rotating or idling slowly, say 4 to 5 revolutions/minute by a drive 6′ or 6″ later described in connection with FIGS. 2A and 2B, being contacted continually by the heated roll $R_2$. When the coating process stops, the idlers I are automatically moved to the right, as in the solid-line showing of FIG. 1B, to introduce web slack and disengage the web 1 out of contact with the back-up roll $R_1$ so that such slow rotation can be achieved. Simultaneously, the hot melt applicator nozzle N, with the hot melt feed valved-off, is moved to a stowed position B′ to the right (solid line showing) to avoid the thermally sensitive web being subjected to degrading localized heat radiation from the nozzle. When, however, the coating process is re-started and the drive D puts the web back into motion, the nozzle N synchronously moves back into the solid-line coating position of FIG. 1A, (gap B), and starts coating. The idlers I correspondingly have moved synchronously to the left to engage the web with the back-up roll $R_1$ again, the back and forth movement being schematically represented by the horizontal arrows in FIGS. 1A and 1B. (If the lower idler interferes with the deposited coating, the upper idler can be disposed to contact the web with the back-up roll by itself). The driving of the web causes cessation of the slow idling rotation of the back-up roll and accelerates the rotation to synchronous speed with the web process line speed as monitored by the conventional line speed monitor M.

Figure 2B:
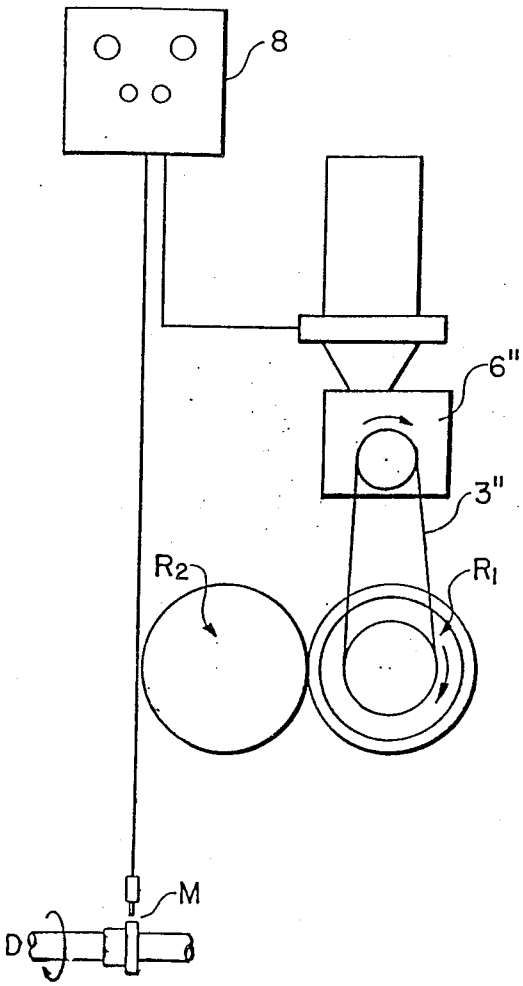
FIGS. 2A and 2B are similar views illustrating alternative drive systems for the apparatus of FIGS. 1A and B.
Figure 2A:
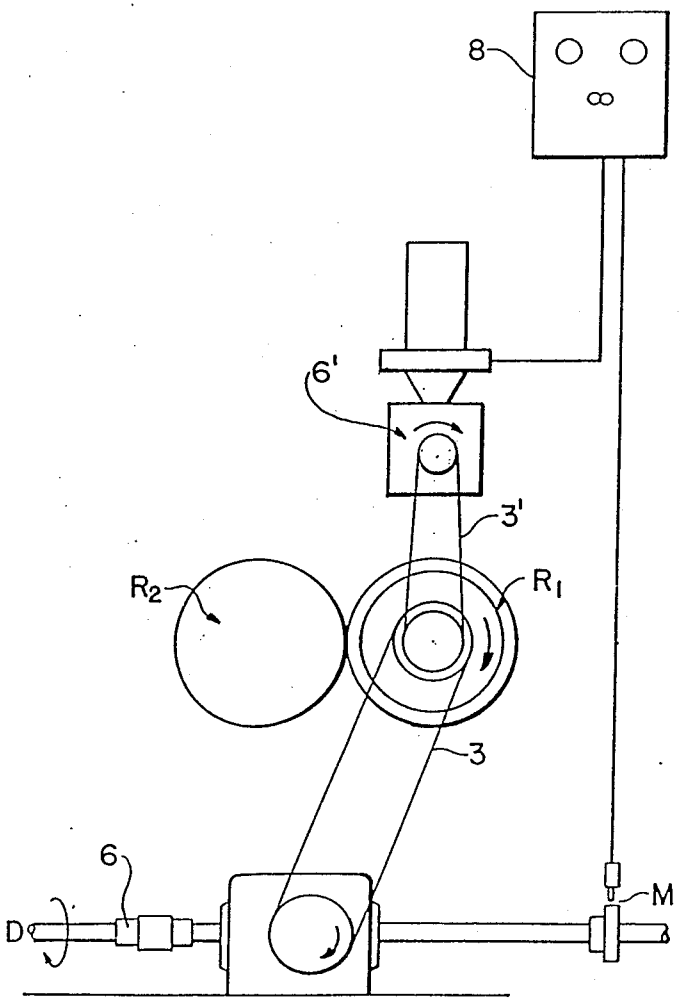

FIGS. 2A and 2B illustrate alternative systems for enabling this stopped position idling (FIG. 1B) and web coating operation (FIG. 1A). In the embodiment of FIG. 2A, the back-up roll $R_1$ is shown pulley-driven at 3 from a direct main drive input from drive D which, during web drive, FIG. 1A, operates at 6 synchronously to web line speed. An auxiliary drive 6′ is provided controlled by a digital motor speed control 8 of conventional type in response to the web-line speed sensed at M and having a "sprag" over-ride clutch coupling that, when operative upon web line stoppage, drives the back-up roll $R_1$ through pulley 3′ at, for example, the idling 4 to 5 RPM speed before mentioned during the periods of web line shut-down. Once web motion is sensed (M) at start-up, the auxiliary motor 6′ is required by the control 8 to stop.

An alternative drive arrangement illustrated in FIG. 2B uses a variable speed digital motor drive 6″, pulleyed to the back-up roll $R_1$ at 3″, to drive the same synchronously to web speed using a signal from 8 directly from the process drive. At web "stop", the speed control 8 reverts to a throw-back drive mode set to operate the variable speed motor drive 6″ at, for example, said idling or relaxed 4-to-5 RPM speed, FIG. 1B, until web start-up, again, as in FIG. 1A.

To summarize the sequence of operation, in the web stopped condition of FIG. 1B, with power on, the back-up roll auxiliary motor drive 6′ of FIG. 2A or the variable speed motor drive 6″ of FIG. 2B will be driven at a preset rotation speed of, say, 4–5 RPM to allow consistent temperature conduction between the heated roll $R_2$ and the back-up roll $R_1$.

At "web start", the web positioning idler rolls I, FIG. 1A, move into applicating position, creating a web wrap around the back-up roll $R_1$. Simultaneously, the coating nozzle N moves into position creating the extrusion process. The auxiliary motor drive with sprag clutch 6′, FIG. 2A, is over-ridden at this stage and is signalled to stop, or the drive is automatically signalled, FIG. 2B, to follow synchronously with the web speed.

At the web 'stop' signal, the applicator extrusion process is cycled off, the applicator nozzle N is positioned as shown in FIG. 1B, creating a large gap B′. Simultaneously, the web-positioning idler rolls I move away from the back-up roll position allowing the web to relax away from the back-up roll surface. If the drive arrangement of FIG. 2A is used, as the web decelerates to stop, the auxiliary motor drive 6″ is signalled to drive the back-up roll at the idling rotation speed of 4–5 RPM. If, however, the drive arrangement of FIG. 2B is used, the variable speed motor drive 6″ is signalled at web stop, and goes into a throw-back mode to drive the back-up roll at a preset rotation speed of such 4–5 RPM.

Figure 3B:
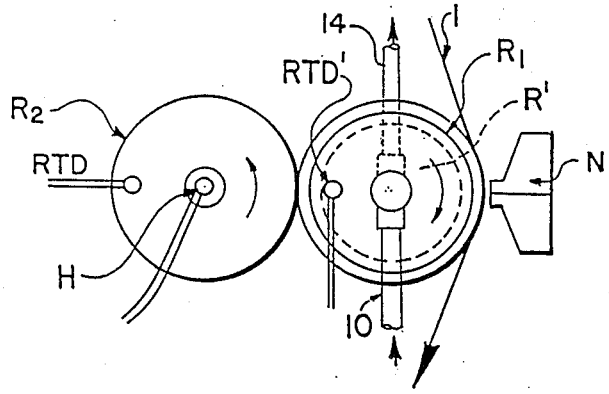

While electrical heating H of a solid heater roll $R_2$ has been illustrated in FIGS. 1A and B, which transfers heat directly to the surface of the silicone or other rubber or rubber-like back-up roll $R_1$, it may be desired to introduce heat from within the back-up roll $R_1$ as well, as for producing temperature effects throughout the roll. The introduction of such heat within and through a hollow tube R′ carried through the back-up roll $R_1$ is shown in FIG. 3B, the heat being supplied to the back-up roll at 10 from, for example, the heat source 12 of FIG. 5B, and returned at 14, with respective conventional rotary unions for the connection of the heat supply and return lines to the heating tube or roll R′ shown at 10′ and 14′, respectively. The internal tube or roll R′ may be symmetrically located within and along the back-up roll $R_1$ as shown. The heater roll $R_2$, moreover, need not be electronically heated but may also be provided with an internal heat-conducting tube or roll R″, FIGS. 4B, 5A and 5B, with inlet heating supply and return lines 10″ and 14″. The heat supply 12′ for the roll $R_1$ is shown at the top in FIGS. 5A and 5B. Temperature control by sensors RTD′ may independently achieve control of the internal heating of the back-up roll $R_1$.

Figure 4A:
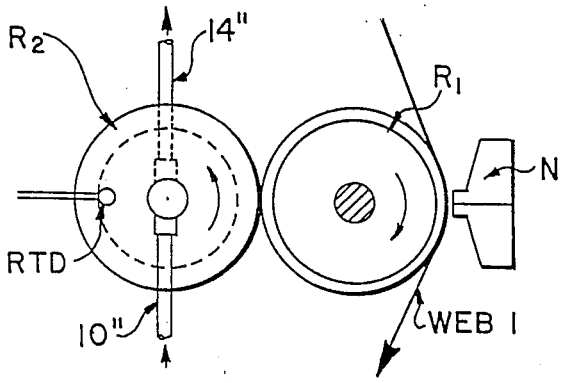
Figure 4B:
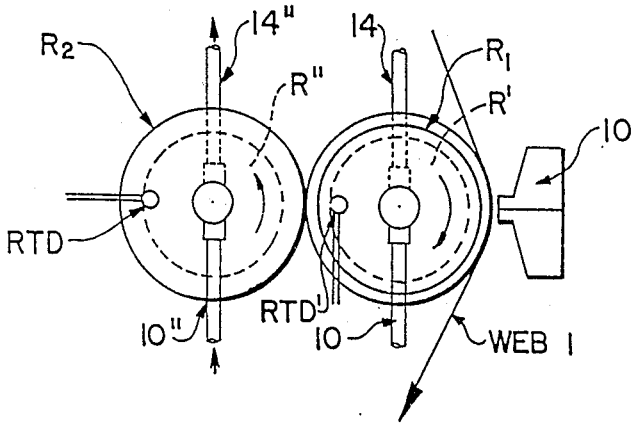
Figure 5A:
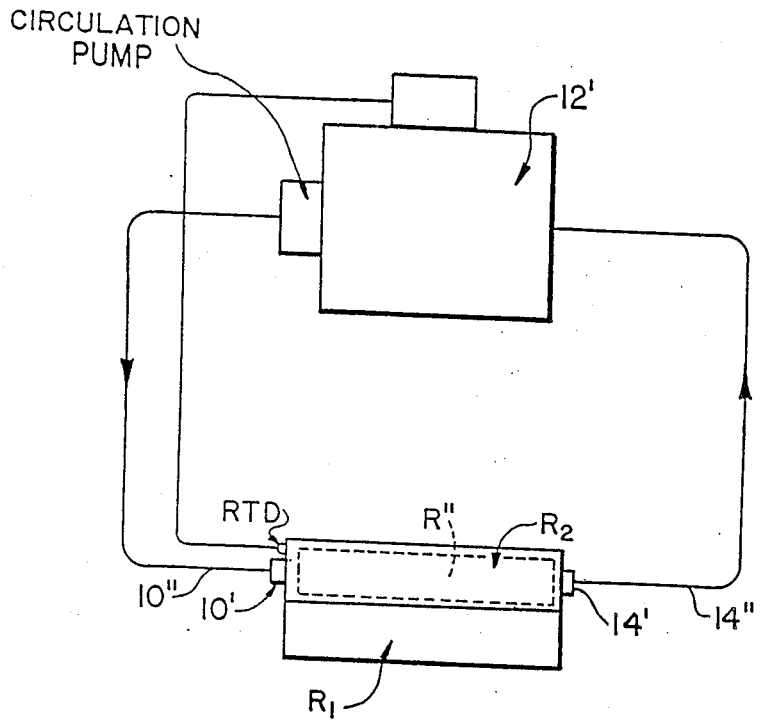
FIGS. 5A and 5B are alternative heating and cooling diagrams suitable particularly for the heating and/or cooling apparatus of respective FIG. 1A and FIGS. 3B and 4B.
Figure 5B:
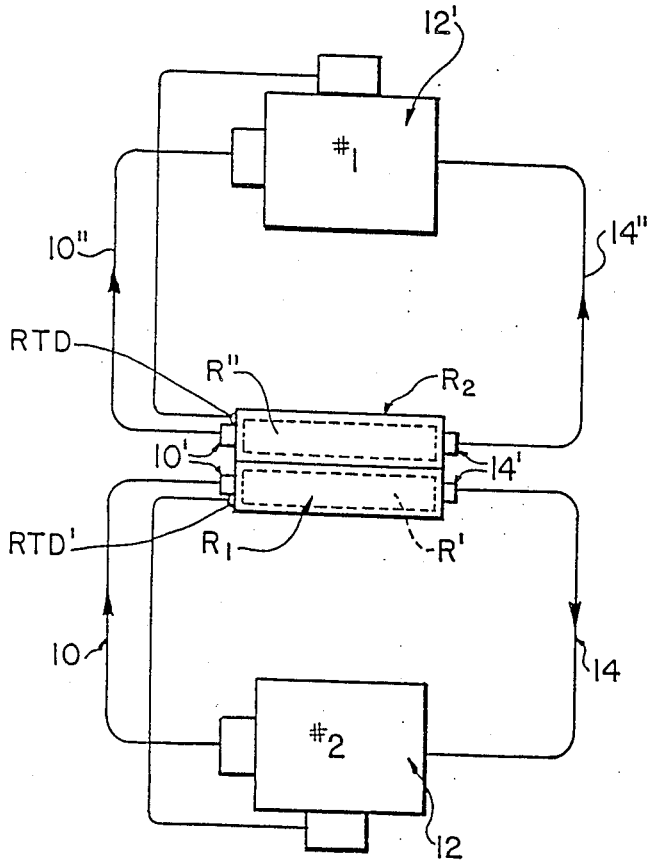

While the potential heat-sink effect of the conducting heat roll $R_2$ was previously described, there may be occasions where the roll $R_2$ should actually be a cooling or chill roll, as shown in FIG. 4A; and, indeed, the back-up roll may also be internally cooled or chilled as in FIG. 4B. In such events, the sources 12′ and 12 of respective FIGS. 5A and 5B will be refrigerant or cooling sources and the supply inlets 10 and 10″ and returns 14 and 14″ will connect therewith as shown. Again, temperature control by sensors RTD and RTD′ is achievable. Various combinations of heating and chilling in rolls $R_1$ and $R_2$, moreover, may also be effected with the flexibility of the invention.

Modifications will occur to those skilled in the art and such are considered to fall within the spirit and scope of the invention as defined in the appended claims.

I claim:

1. A method of maintaining uniform hot melt coatings on thermally sensitive webs by maintaining the dimensional stability of silicone and rubber-like web back-up rolls that would otherwise be subject to dimensional variations as hot melt is deposited from a nozzle upon the front of the web, with attendant nozzle-to-web spacing variation as well, the method comprising, continuously contacting the surface of the back-up roll with a heat-conducting roll that, with increased surface temperature of the back-up roll, can directly remove heat as a heat sink from the back-up roll, and with decrease in back-up roll surface temperature can directly contact-heat the surface of the back-up roll; sensing variations in heat of the surface of the back-up roll in response to the deposition of hot melt from the nozzle onto the front of the web and the transfer of heat from the back-up roll to the back of the web that would tend to introduce web coating variations and degradation; and controlling the temperature of the heat-conducting roll in response to such sensing to control the direct transfer of heat between the back-up and heat-conducting rolls and vice versa so as to maintain the substantial dimensional stability of the back-up roll and of the nozzle-to-web spacing.

2. A method as claimed in claim 1 and in which the back-up roll is internally heated.

3. A method as claimed in claim 1 and in which the back-up roll is cooled.

4. A method as claimed in claim 1 and in which the heat-conducting roll is chilled.

5. A method as claimed in claim 1 and in which, prior to coating, in the rest position, the web is maintained out of contact with the back-up roll while that roll is continually slowly rotated against the heat-conducting roll; and engaging the said back of the web with the back-up roll upon the start of the movement of the web and simultaneously depositing hot melt coating upon the front thereof, the back-up roll thereupon being rotated rapidly such that its surface speed matches the web process line speed.

6. A method as claimed in claim 5 and in which, prior to coating, the nozzle is moved away from the web to minimize heat radiation effects upon the web in the rest position, and the nozzle is moved back toward the web for effecting coating deposition upon the start of the web movement.

* * * * *